United States Patent [19]

Chang

[11] Patent Number: 4,910,870

[45] Date of Patent: Mar. 27, 1990

[54] LEVERED TOOL WITH COOPERATING JAWS

[76] Inventor: Chung-Hsing Chang, No. 5, Chang Ma Street, Ma Hsing Village, Shiow Shoei Shi, Chang Huah, Taiwan

[21] Appl. No.: 247,435

[22] Filed: Sep. 9, 1988

[30] Foreign Application Priority Data

Jan. 4, 1988 [TW] Taiwan ..... 77202901

[51] Int. Cl.[4] ..... B26B 17/02

[52] U.S. Cl. ..... 30/192; 30/242; 30/252

[58] Field of Search ..... 30/190–193, 30/252, 242

[56] References Cited

U.S. PATENT DOCUMENTS 2,910,900 11/1959 Klein ..... 30/193 X
3,074,164 1/1963 Porter ..... 30/193

FOREIGN PATENT DOCUMENTS 3221072 12/1983 Fed. Rep. of Germany ..... 30/193
600190 11/1959 Italy ..... 30/191

*Primary Examiner*—Frank T. Yost
*Assistant Examiner*—Rinaldi Rada
*Attorney, Agent, or Firm*—Browdy and Neimark

[57] ABSTRACT

A levered tool includes two cooperating jaws, two cover plates pivotably mounting therebetween the jaws, two handles providing a levering function for the jaws, and two pivotally connected toggles each of which includes a first end pivotally connected to one of the jaws and a second end fixed to one of the handles, wherein the tool is further provided with an adjusting device connected between the toggles and capable of adjusting the distance between the first ends of the toggles.

3 Claims, 6 Drawing Sheets

LEVERED TOOL WITH COOPERATING JAWS

BACKGROUND OF THE INVENTION

The present invention relates to a levered tool, and more particularly to one with cooperating jaws.

A levered tool with cooperating jaws is referred to a shearing or clamping tool having two fulcra as exemplarily shown in FIG. 1 showing a pair of metal shears which includes two cooperating jaws 11, two cover plates 12, two bolts 13 pivotally bolting jaws 11 between plates 12 and forming thereat first fulcra (A), two handles 14, and two toggles 15 pivotally connected together by a bolt 16 and each of which includes a first end fixed to one of handles 14 and a second end pivotally connected to one of jaws 11 with an interconnecting joint therebetween forming thereat a second fulcrum (B). Such tool is energy-saving, however, a relatively high precision is required for the tool parts in order that the jaws 11 can be fully closed together, which means a relatively high cost of the tool. For example, if jaws 11 are found incapable of being fully closed after the tool is assembled, the tool parts can only be disassembled to be re-worked.

In an effort to overcome the above shortcoming, a levered tool having an adjusting means has been developed as exemplarily shown in FIG. 2 showing a pair of metal shears which includes two jaws 21, two cover plates 22, two bolts 23 forming first fulcra (A), two handles 24, and two toggles 25 pivotally connected by a bolt 20 and connected between jaws 21 and handles 24 with joints between jaws 21 and toggles 25 forming second fulcra (B), wherein one of toggles 25 is provided thereon with a slit 26 and includes a bolt 27 which bolts across slit 26 and has a grooved end 28 pinned by a pin 29, and each bolt 23 includes an eccentrical portion engaging with one respective jaw 21. After assembling the tool, one can rotate bolts 23 to adjust the clearance between jaws 21 by suitably engaging cam portions of bolts 23 with jaws 21 if jaws 21 are found incapable of being fully closed. If jaws 21 have a relatively large clearance therebetween after handles 24 have been fully held together, bolt 27 is screwed further on toggle 25 to reduce the gapping distance of slit 26 to inwardly translate fulcra (B) together by a small distance, in addition to a cooperative rotation of the bolt 23 having just described. Such tool, however, still suffers at least from the following disadvantage that by forcedly adjusting the gapping distance of slit 26 by bolt 27, the range that the distance between fulcra (B) can be adjusted thereby is very limited and might be insufficient in some circumstance. As an example only, if such tool is to shear or clamp a relatively large workpiece, fulcra (B) must have a distance therebetween lengthened to a relatively large extent in order that the workpiece will not easily slip out of the work space between jaws 21 upon clamping or shearing, and such relatively large distance of fulcra (B) cannot be obtained by this tool.

It is therefore attempted by the Applicant to deal with the situation described above.

SUMMARY OF THE INVENTION it is therefore an object of the present invention to provide a levered tool with an adjusting means capable of adjusting the distance between the second fulcra within a relatively great range in order that the required precision for the tool parts can be lowered and the tool can work with a relatively large workpiece.

According to the present invention, a levered tool with cooperating jaws includes two jaws, two cover plates pivotally mounting therebetween the jaws, two handles providing a levering function for the jaws, and two pivotally connected toggles each of which includes a first end pivotally connected to one of the jaws and a second end fixed to one of the handles, wherein the improvement resides in that the tool further includes an adjusting means connected between the toggles, capable of adjusting the distance between the first ends of the toggles, and including a rod member having a first end pivotally connected to one of the toggles and a second threaded end, and an adjusting member rotatably received in the other toggle and having a through threaded hole threadedly engaging therein the second threaded end.

The present invention may best be understood through the following description with reference to the accompanying drawings, in which:

DETAILED DESCRIPTION OF THE PREFERRED EMBODIMENT

Figure 1:
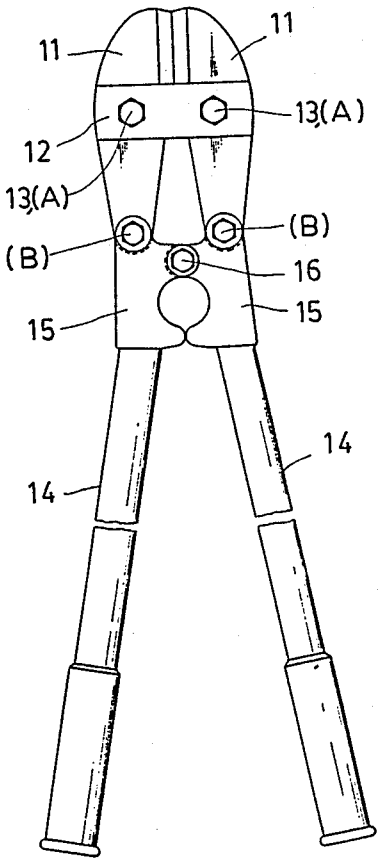
FIG.1 PRIOR ART
FIG. 1 is a front view showing a levered tool with cooperating jaws according to the prior art.
Figure 2:
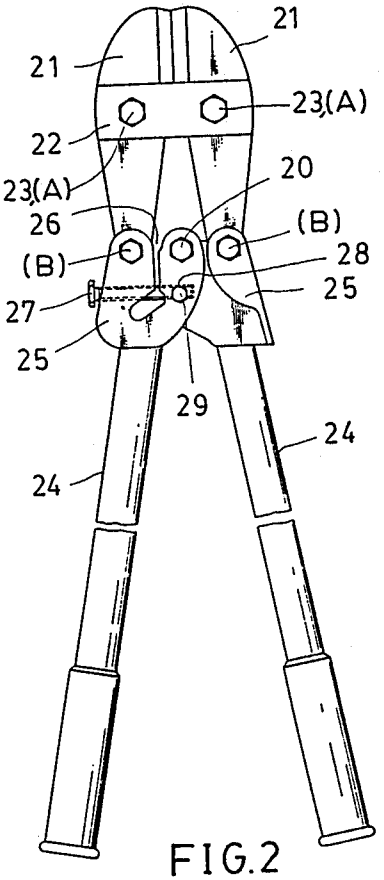
FIG.2 PRIOR ART
FIG. 2 is a front view showing further a levered tool with cooperating jaws according to the prior art.
Figure 3:
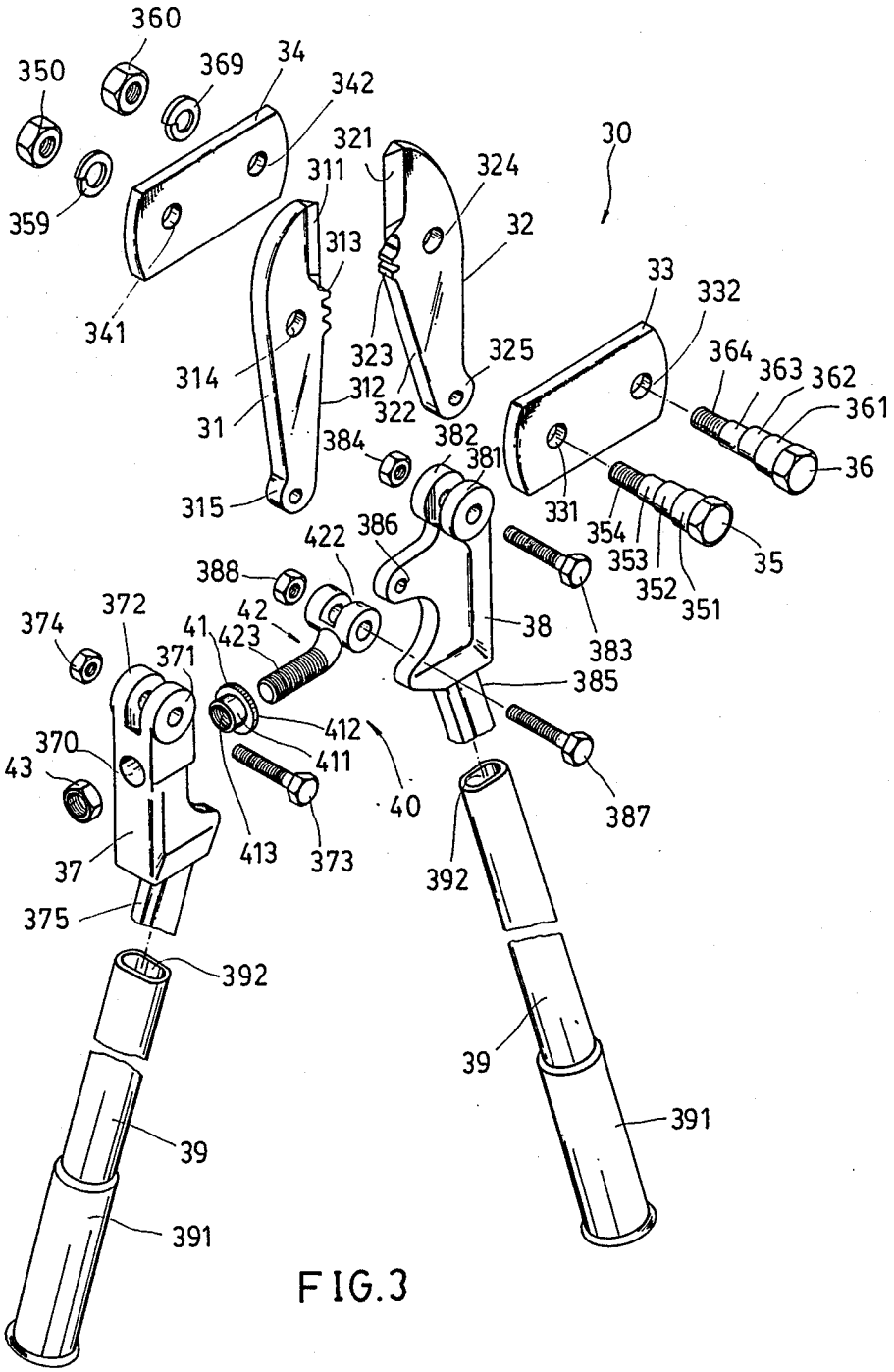
FIG. 3 is an exploded view showing a first preferred embodiment of a levered tool with cooperating jaws according to the present invention.
Figure 4:
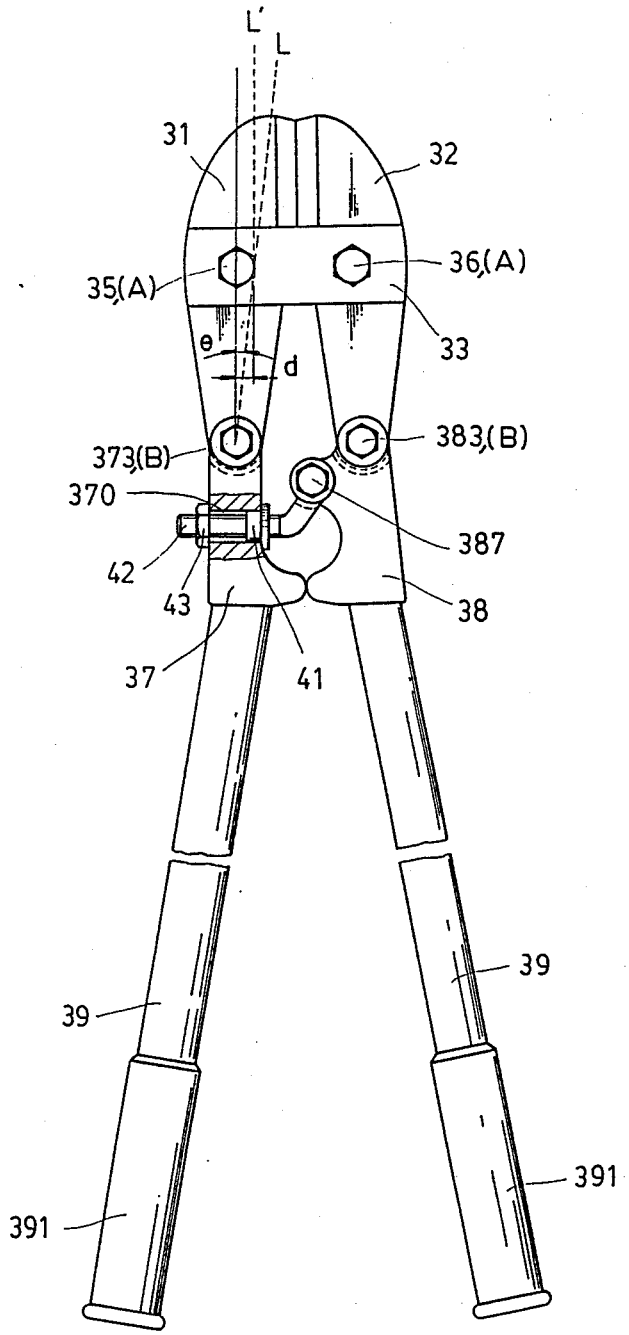
FIG. 4 is an assembled front view of a tool in FIG. 3.

Referring now to FIGS. 3 & 4, a first preferred embodiment of a levered tool 30 with cooperating jaws according to the present invention includes two jaws 31, 32, two cover plates 33, 34, two bolts 35, 36 pivotally bolting jaws 31, 32 between cover plates 33, 34 and forming thereat two first fulcra (A), two toggles 37, 38 having first ends pivotally connected to jaws 31, 32 and second ends secured to handles 39, and an adjusting means 40 connected between toggles 37, 38 and capable of adjusting the distance between the first ends of toggled 37, 38.

Each jaw 31 (32) includes a blade 311 (321), a lower portion 312 (322) having a holed end 315 (325), an interengaging toothed portion 313 (323), and a pivotal hole 314 (324).

Each bolt 35 (36) is multi-stepped to include a largest first cylindrical portion 351 (361), an eccentrical portion 352 (362), a second cylindrical portion 353 (363) and a diametrally smallest threaded portion 354 (364), and penetrates through holes 331, 341 (332, 342) of cover plates 33, 34 and hole 314 (324) to have threaded portion 354 (364) threadedly engaged by a nut 350 (360) and a washer 359 (369) in the manner that portions 351, 353 (361, 363) are positioned in holes 331, 341 (332, 342) and portion 352 (362) is positioned in hole 314 (324).

Each toggle 37 (38) has first forked holed ends 371, 372 (381,382) through which a bolt 373 (383) penetrates to be threadedly engaged by a nut 374 (384) in order to pivotally connect therebetween holed end 315 (325), and a second end 375 (385) fixed in a hollow end 392 of handle 39 provided with a plastic sleeve 391.

Adjusting means 40 includes an adjusting member 41, a rod member 42 and a nut 43. Adjusting member 41 includes a tubular portion 411 rotatably received in a through hole 370 of toggle 37, a knurled adjusting flange 412 matching against the inner side surface of toggle 37, and a through threaded hole 413. Rod member 42 has a forked end 422 through which a bolt 387 penetrates to be engaged by a nut 388 in order to pivotally bolt therebetween a holed portion 386 of toggle 38, and a threaded end 423 threaded engaged in threaded hole 413 and protruding beyond through hole 370 to be threadedly engaged by nut 43 which urges the inner side surface of toggle 37 against adjusting flange 412 from the outer side surface of toggle 37. Thus, by adjusting the positions of adjusting member 41 and nut 43 on threaded end 423, the distance between bolts 373, 383 can be adjusted accordingly.

The operation of the present invention may be exemplarily described as follows:

Construct a solid line connecting a first fulcrum (A) formed by bolt 35 and a second fulcrum (B) formed by bolt 373. If jaws 31, 32 still have a relatively small clearance therebetween after handles 39 have been fully held together, bolt 35 is rotated to allow eccentrical portion 352 in hole 314 to inwardly pivot jaw 31 about fulcrum 9B) to form a new dotted line L connected between hole 314 and fulcrum (B) and to thus obviate the small clearance.

If the clearance between jaws 31, 32 is relatively large after handles 39 are held together and cannot be deleted merely by rotating bolt 35, then, in addition to a proper rotation of bolt 35 (and/or bolt 36), adjusting member 41 is rotated on threaded end 423 to bring together fulcra (B) by a small distance to construct a new dotted line L connecting hole 314 and second fulcrum (B). If blades 311, 321 are overlapped after handles 39 are held together, the distance between fulcra (A) and/or (B) needs to be lengthened by properly rotating adjusting member 41 and/or bolt 35 in a similar manner having just described. Since the range that the distance between fulcra (B) can be adjusted is expanded to a relatively large extent, the required precision for the relevant tool parts is lowered accordingly.

Figure 5:
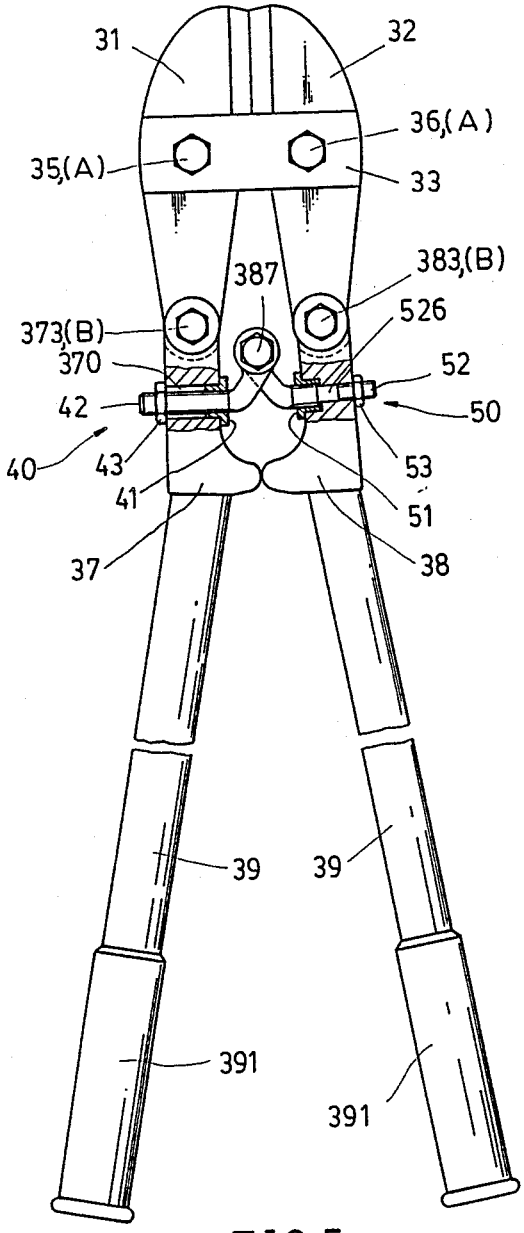
FIG. 5 is a front view showing a second preferred embodiment of a levered tool with cooperating jaws according to the present invention.
Figure 6:
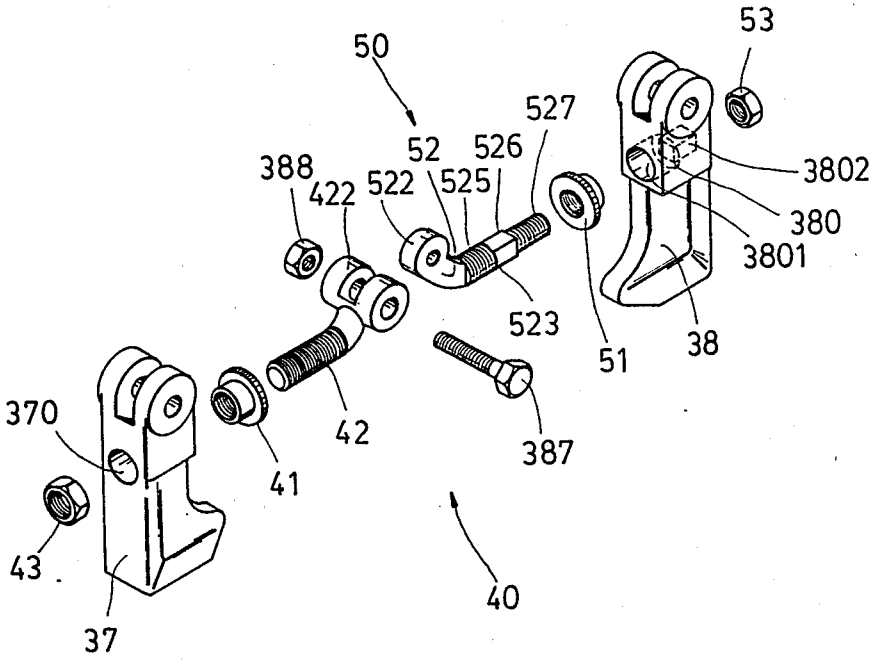
FIG. 6 is an exploded view showing a first and a second adjusting means and two toggles of a levered tool in FIG. 5.

As shown in FIGS. 5 and 6 in which the elements the same to those shown in FIGS. 3 and 4 still use the same reference numerals, a second preferred embodiment of the present invention further includes a second adjusting means 50 including an adjusting member 51, a rod member 52 and a nut 53. Rod member 52 includes a holed end 522 pivotally connected to forked end 422 by bolt 387 and nut 388, and a stepped end 523 including a first threaded portion 525, a squared portion 526 having a diagonal length shorter than the diameter of portion 525, and a second threaded portion 527 having a diameter shorter than the diagonal length of portion 526. Toggle 38 includes a through hole 380 including a cylindrical room 3801 receiving therein threaded portion 525 and a squared room 3802 capable of receiving therein squared portion 526 so that stepped end 523 is slidably but non-rotatably received in through hole 380. Adjusting member 51 having a through threaded hole threadedly engaging therein threaded portion 525 and being partly and rotatably received in cylindrical room 3801 also includes a knurled adjusting flange matching against the inner side surface of toggle 38. Nut 53 threadedly engages therein threaded portion 527 protruding beyond through hole 380 so as to urge the inner side surface of toggle 38 against the knurled adjusting flange from the opposite outer side surface of toggle 38. With the provision of second adjusting means 50 having a rod member 52 slidably but non-rotatably received in through hole 380, the range that the distance between second flucra (B) can be adjusted is further increased. Such tool is particularly suitable for, e.g. working a relatively large object, since the object slips out from the space between jaws 31, 32 easily of a normal levered tool incapable of conveniently working the relatively large object. This situation can be dealed with by the second preferred embodiment of the present invention by properly increasing the distance between fulcra (A) and by increasing to a relatively large extent the distance between fulcra (B) by properly both adjusting the adjusting members 41 and 51 so that the lower ends of blades 311, 321 still have a clearance therebetween when the upper ends of blades 311, 321 have got closed, after handles 39 have been held together. Thus, upon closing, blades 311, 321 will have therebetween a reduced included angle so that the outward force component occurred to the object gripped between blades 311, 321 is accordingly reduced when handles 39 are urged together.

Figure 7:
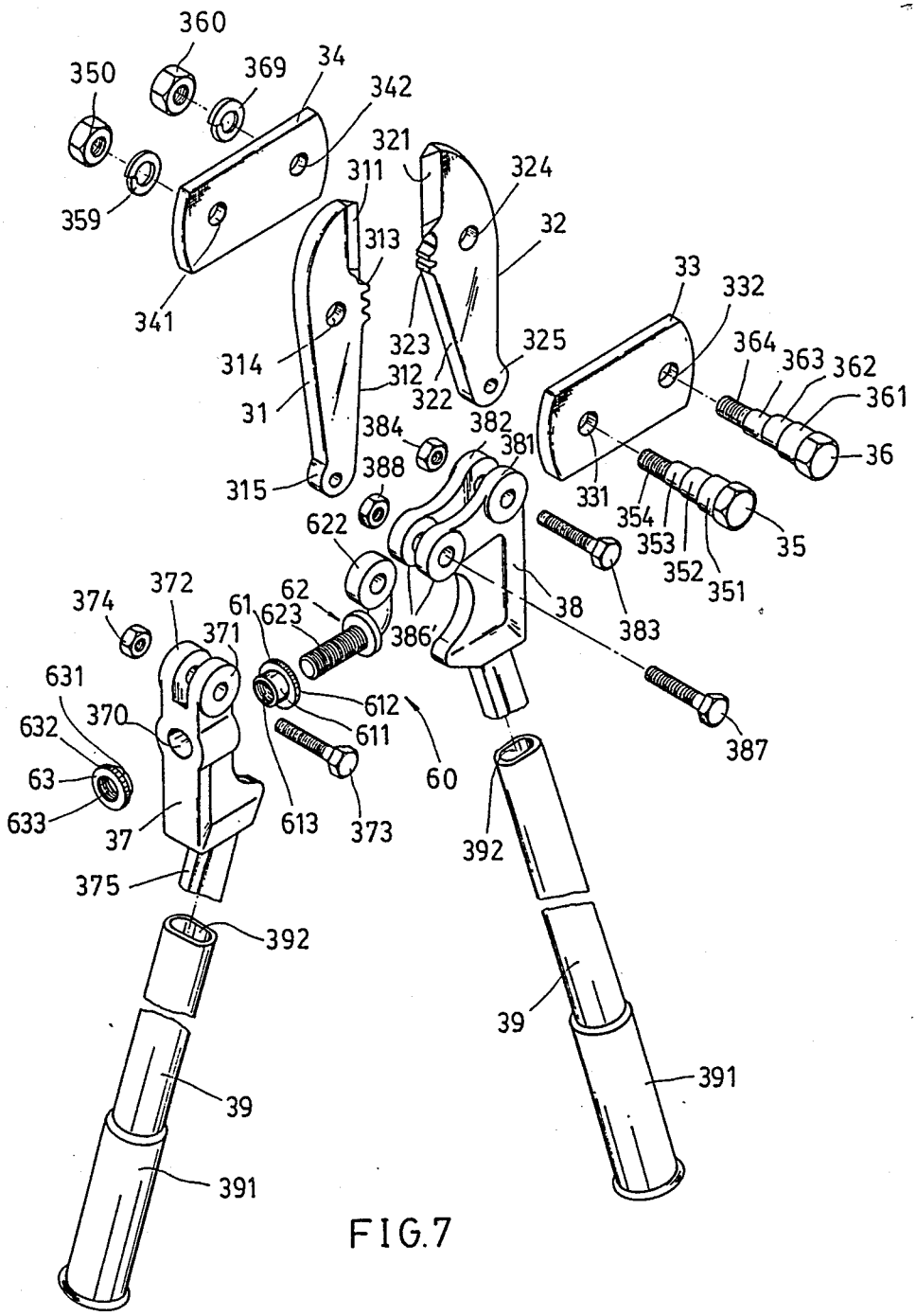
FIG. 7 is an exploded view showing a third preferred embodiment of a levered tool with cooperating jaws according to the present invention.

As shown in FIG. 7, there is shown a third preferred embodiment of a levered tool according to the present invention which is the same to the first preferred embodiment with the exception that the adjusting means has a slightly different structure and bears a reference numeral 60 to include and adjusting member 61, a rod member 62 and a tubular member 63. Adjusting member 61 includes a tubular portion 611 rotatably received in through hole 370, a knurled adjusting flange 612 matching against the inner side surface of toggle 37, and a through threaded hole 613. Rod member 62 includes a holes end 622 pivotally bolted between a forked portion 386 of toggle 38 by bolt 387 and nut 388, and a threaded end 623 threadedly engaging in threaded hole 613 and protruding beyond through hole 370. Tubular member 63 includes a tubular portion 631 rotatably received in through hole 370, a knurled flange 632 and a through threaded hole 633 threadedly engaging therein the protruded threaded end 623 so that flange 632 will urge the inner side surface of toggle 37 against adjusting flange 612 from the opposite outer side surface of toggle 37. if the distance between bolts 373, 383 (fulcra (B)) were to be increased, adjusting member 61 is further screwed on threaded end 623 and then tubular member 63 is also further screwed on threaded end 623 to urge the inner side surface of toggle 37 against adjusting flange 612. Since adjusting flange 612 and flange 632 are knurled to be hand-operated, no tool such as a wrench is required in adjusting the distance between fulcra (B).

Through the above description, it should now become readily apparent how and why the present invention can achieve the object it contemplates.

it can be noticed that further modifications can be made to the preferred embodiments having just described without departing from the spirit and scope of the appended claims.

What I claim is:

1. A levered tool with cooperating jaws comprising two cooperating jaws adapted to clamp or shear therebetween an object, two cover plates pivotably mounting therebetween said two jaws in a manner that said two jaws are capable of working said object, two handles capable of providing a levering function for said two jaws, and two toggles pivotally connected together and each of which includes a first end pivotally connected to one of said jaws and a second end fixed to one of said handles, wherein the improvement resides in that said tool further includes:

a first adjusting means mounted and connected between said two toggles, capable of adjusting a distance between said first ends of said toggles, providing the pivotal connection between said toggles, and including:

a first rod member having a first end pivotably connected to one of said toggles and a second threaded end; and a first adjusting member rotatably received in the other said toggle and having a through threaded hole threadedly engaging therein said second threaded end; and a second adjusting means connected between said first adjusting means and said one toggle so that said distance can be adjusted in a greater extent, and including:

a second rod member having a third end pivotably connected to said first rod member including a sliding means capable of axially sliding in but incapable of rotating with respect to said one toggle, and a first threaded portion; and a second adjusting member rotatably received in said one toggle and having a second through threaded hole threadedly engaging therein said first threaded portion.

2. A levered tool with cooperating jaws according to claim 1 wherein:

said sliding means includes a square portion having a diagonal length shorter than a diameter of said first threaded portion, and said second rod member further includes a second threaded portion having a diameter shorter than said diagonal length;

said one toggle includes a third through hole slidably and non-rotatably receiving therein said second rod member;

said third through hole includes a cylindrical room receiving therein said first threaded portion and a squared room capable of receiving therein said squared portion;

said second adjusting member further includes a second adjusting flange matching against an inner side surface, with respect to said tool, of said one toggle;

said second threaded portion protrudes beyond said third through hole; and said tool further includes a second nut threadedly engaging therein said protruded second threaded portion for urging said inner side surface of said one toggle against said second adjusting flange from an opposite outer side surface of said one toggle.

3. A levered tool with cooperating jaws comprising two cooperating jaws adapted to clamp or shear an object therebetween, two cover plates pivotably mounting therebetween said two jaws in a manner that said two jaws are capable of working said object, two handles capable of providing a levering function for said two jaws, and two toggles pivotally connected together and each of which includes a first end pivotally connected to one of said jaws and a second end fixed to one of said handles, wherein the improvement resides in that said tool further includes an adjusting means which is mounted and connected between said two toggles and capable of adjusting a distance between said first ends of said toggles, provides the pivotal connection between said toggles, and includes:

a rod member having a first threaded portion and a third end pivotally connected to one of said toggles, and a means capable of axially sliding in but incapable of rotating with respect to the other said toggle; and an adjusting member rotatably received in said the other toggle and having a threaded through hole threadedly engaging therein said first threaded portion.

* * * * *